US011598605B2

(12) United States Patent
McPherson et al.

(10) Patent No.: US 11,598,605 B2
(45) Date of Patent: Mar. 7, 2023

(54) STABILIZING GRIP FOR SHOOTING DEVICE

(71) Applicant: MCP IP, LLC, Sparta, WI (US)

(72) Inventors: Mathew A. McPherson, Norwalk, WI (US); Jeffrey A. Ozanne, La Crosse, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 17/108,992

(22) Filed: Dec. 1, 2020

(65) Prior Publication Data

US 2021/0102779 A1 Apr. 8, 2021

Related U.S. Application Data

(63) Continuation of application No. 16/544,635, filed on Aug. 19, 2019, now Pat. No. 10,852,099, which is a continuation-in-part of application No. 16/384,731, filed on Apr. 15, 2019, now Pat. No. 10,900,742.

(60) Provisional application No. 62/657,617, filed on Apr. 13, 2018.

(51) Int. Cl.

| | |
|---|---|
| ***F41C 23/16*** | (2006.01) |
| ***F41G 11/00*** | (2006.01) |
| ***F41C 27/22*** | (2006.01) |

(52) U.S. Cl.

CPC ..... *F41C 23/16* (2013.01); *F41C 27/22* (2013.01); *F41G 11/003* (2013.01)

(58) Field of Classification Search

CPC ..... F41C 23/16
USPC ..... 42/71.01–74
See application file for complete search history.

(56) References Cited

U.S. PATENT DOCUMENTS

| | | | | | |
|---|---|---|---|---|---|
| 888,560 | A * | 5/1908 | White | F41A 17/38 | 42/7 |
| 1,355,425 | A * | 10/1920 | Pedersen | F41A 17/20 | 89/145 |
| 1,387,938 | A * | 8/1921 | Pedersen | F41A 17/20 | 89/148 |
| 1,518,831 | A * | 12/1924 | Wright | F41A 17/38 | 42/7 |
| 2,182,693 | A * | 12/1939 | Harton | F41A 17/20 | 42/70.01 |
| 2,414,250 | A | 1/1947 | Williams | | |
| 2,691,232 | A * | 10/1954 | Hoopes | F41A 17/26 | 42/70.08 |
| 2,978,826 | A * | 4/1961 | Ivy | F41A 17/22 | 42/70.06 |

(Continued)

OTHER PUBLICATIONS

Product page for "American Legend Grip Colt 1911" by Pachmayr on Amazon.com (Year: 2009).*

*Primary Examiner* — Samir Abdosh
(74) *Attorney, Agent, or Firm* — Laabs Intellectual Property

(57) ABSTRACT

In some embodiments, a grip for a shooting device comprises a first body portion configured for attachment to the shooting device and a second body portion engaged with the first body portion. The second body portion is moveable with respect to the first body portion between first and second positions. A biasing member is arranged to bias the second body portion to the first position. In some embodiments, the second body portion comprises a guard defining a guard cavity and at least a portion of the first body portion is oriented in the guard cavity.

14 Claims, 18 Drawing Sheets

(56) References Cited

U.S. PATENT DOCUMENTS 3,487,824 A * 1/1970 Profitt ..... F41B 7/006 124/52
3,735,519 A * 5/1973 Fox ..... F41A 17/04 42/70.11
4,221,066 A * 9/1980 Hillberg ..... F41C 23/10 42/71.02
4,735,008 A * 4/1988 Williams ..... F41C 23/10 42/72
4,798,018 A * 1/1989 Johansson ..... F41A 17/38 42/7
5,761,842 A * 6/1998 Mantymaa ..... F41C 23/12 42/72
7,340,857 B1 3/2008 Bentley
7,559,167 B1 7/2009 Moody et al.
7,676,975 B2 3/2010 Phillips et al.
7,685,755 B1 3/2010 Bentley
7,861,451 B1 * 1/2011 Moody ..... F41C 23/16 42/71.01
7,891,126 B2 2/2011 Moody et al.
7,987,625 B1 8/2011 Moody et al.
7,997,258 B2 8/2011 Shepley et al.
8,156,676 B1 * 4/2012 Moody ..... F41A 23/06 42/71.01
8,215,047 B2 7/2012 Ash, Jr. et al.
8,341,865 B2 1/2013 Moody et al.
8,393,104 B1 3/2013 Moody et al.
8,601,734 B1 * 12/2013 Hopkins ..... F41C 23/14 42/71.01
8,607,492 B2 12/2013 Hartley et al.
8,839,544 B2 9/2014 Troy et al.
8,857,094 B2 * 10/2014 Michel ..... F41C 23/10 42/71.01
8,984,789 B2 3/2015 Adcock, Jr.
9,062,933 B1 6/2015 Allen et al.
9,228,796 B2 1/2016 Adcock, Jr. et al.
9,228,798 B1 * 1/2016 Viola ..... F41C 23/16
9,234,722 B2 1/2016 Rice et al.
9,423,208 B1 8/2016 Mahmalji
9,523,551 B2 12/2016 Iannello
9,599,429 B1 * 3/2017 Davis ..... F41C 23/16
9,784,529 B1 10/2017 Angle
9,885,538 B2 * 2/2018 Davis ..... F41C 23/16
9,891,020 B2 2/2018 Jen
10,018,446 B2 * 7/2018 Derousse ..... F41C 23/16
10,107,586 B2 * 10/2018 Derousse ..... F41C 23/12
10,197,358 B2 2/2019 Hebden et al.
10,852,099 B2 12/2020 McPherson et al.
10,942,004 B2 * 3/2021 Grenier ..... F41C 23/14
11,112,208 B1 * 9/2021 Mantas ..... F41C 23/16
2006/0191183 A1 * 8/2006 Griffin ..... F41C 23/16 42/72
2009/0313873 A1 * 12/2009 Roth ..... F41C 23/16 42/72
2010/0205795 A1 * 8/2010 Moody ..... F41G 11/003 29/428
2013/0333263 A1 * 12/2013 Hovey ..... F41C 23/16 42/72

* cited by examiner

STABILIZING GRIP FOR SHOOTING DEVICE

CROSS-REFERENCE TO RELATED APPLICATIONS

This application claims the benefit of and is a continuation of U.S. patent application Ser. No. 16/544,635, filed Aug. 19, 2019, which claims the benefit of U.S. patent application Ser. No. 16/384,731, filed Apr. 15, 2019, which claims the benefit of U.S. Patent Application No. 62/657,617, filed Apr. 13, 2018, the entire contents of which are hereby incorporated herein by reference.

BACKGROUND OF THE INVENTION

This invention relates generally to shooting devices, such as devices that can launch a projectile.

Multiple types of shooting devices are generally known in the art. A firearm can be used to launch a bullet, for example via expanding gasses provided by a chemical propellant. Bows can be used to launch arrows, for example by drawing a bowstring to store energy in the bow, then releasing the bowstring to launch an arrow.

Shooting devices are typically aimed by a user prior to the launching of the projectile, with the intention of the projectile traveling to a desired aiming point.

Instability during aiming can contribute to inaccuracy.

There remains a need for shooting devices and accessories having novel designs that can contribute to increased accuracy.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a grip for a shooting device comprises a first body portion configured for attachment to the shooting device and a second body portion engaged with the first body portion. The second body portion is moveable with respect to the first body portion between first and second positions. A biasing member is arranged to bias the second body portion to the first position.

In some embodiments, a shooting device comprises a grip comprising a first body portion attached to the shooting device and a second body portion engaged with the first body portion. The second body portion is moveable with respect to the first body portion between first and second positions. A biasing member is arranged to bias the second body portion to the first position. In some embodiments, the shooting device comprises a shooting vector and applying a force to the grip in the direction of the shooting vector will move the second body portion with respect to the first body portion.

In some embodiments, a grip for a shooting device comprises a first body portion configured for attachment to the shooting device and a resilient member attached to the first body portion. The first body portion supports the resilient member. A second body portion is attached to the resilient member. The second body portion is moveable with respect to the first body portion between first and second positions.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
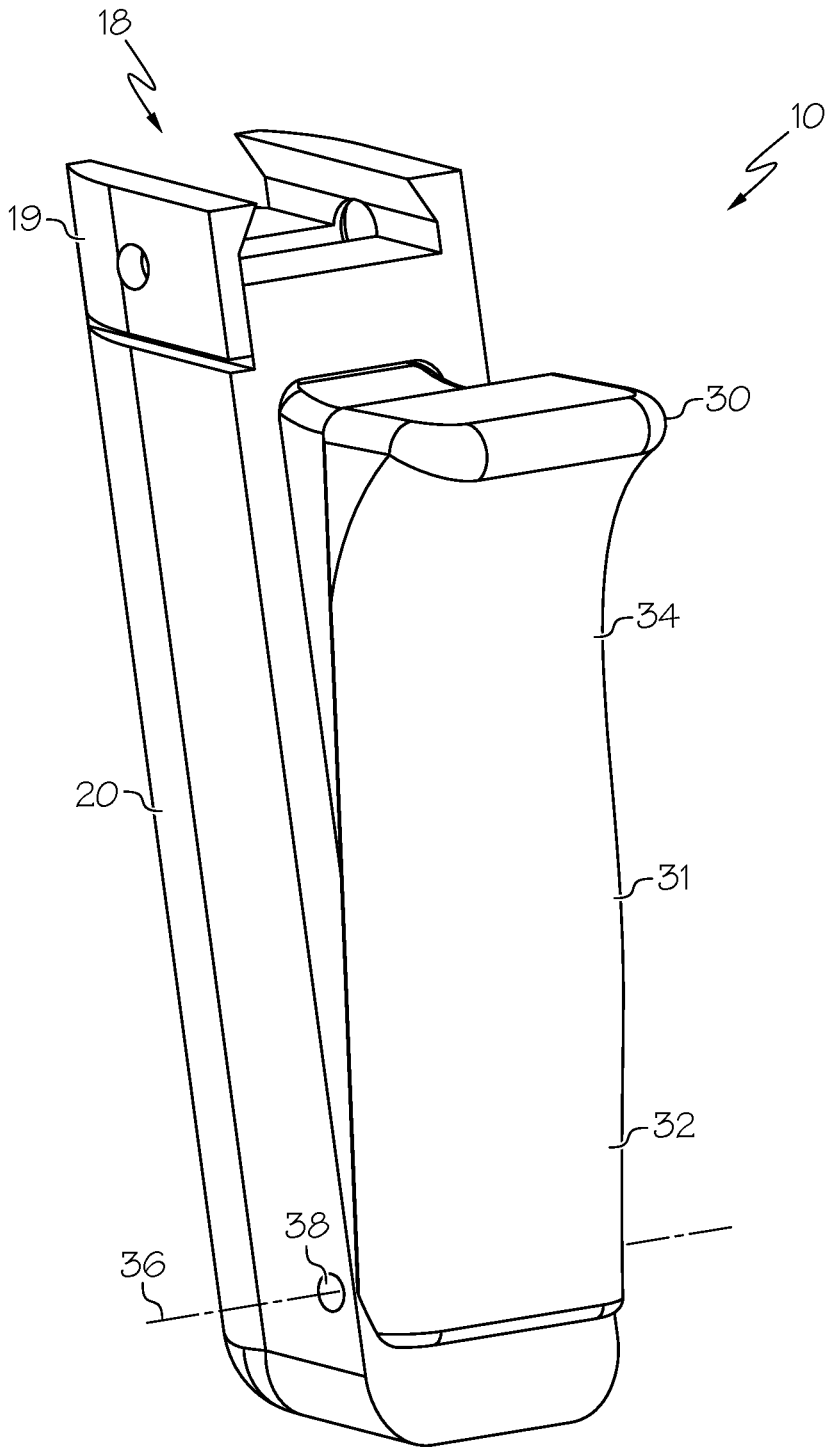
FIG. 1 shows an embodiment of a grip.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
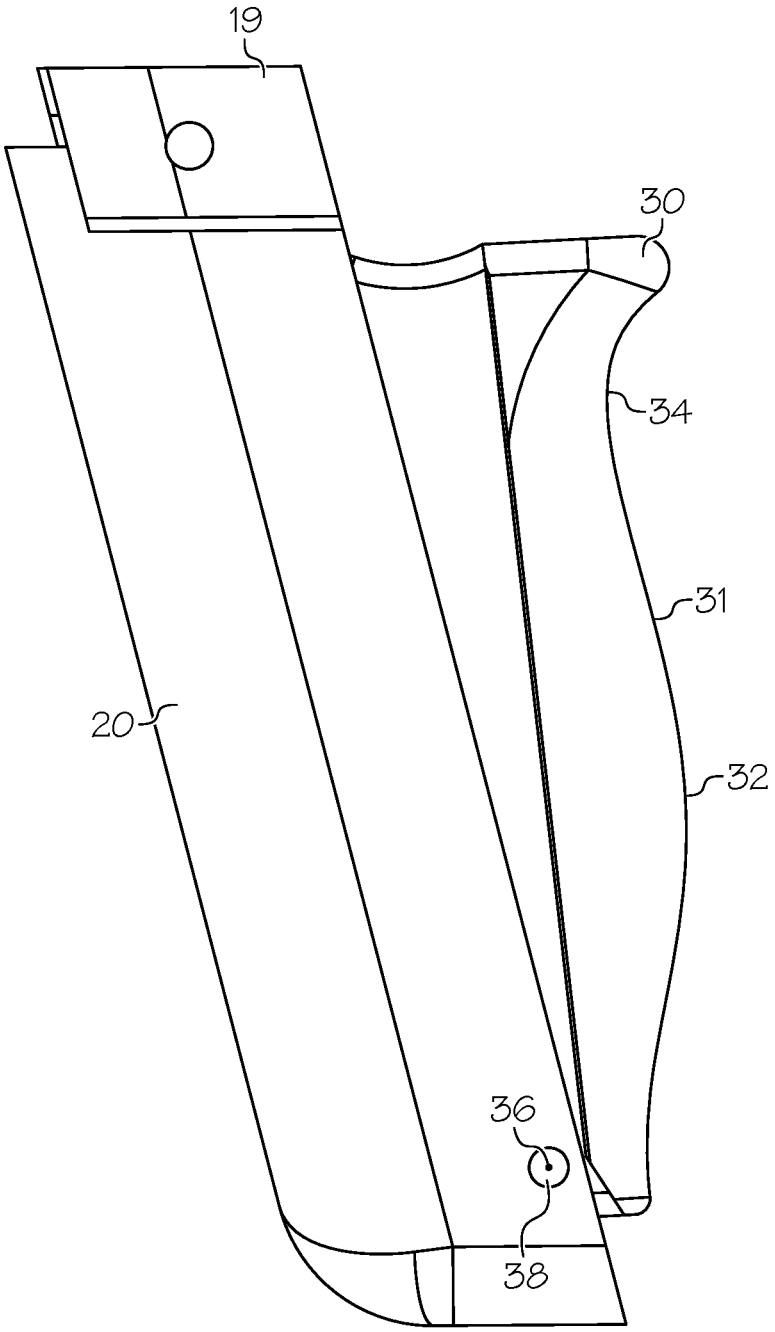
FIG. 2 shows a side view of the grip shown in FIG. 1.

FIG. 1 shows an embodiment of a grip 10, and FIG. 2 shows a side view. In some embodiments, a grip 10 comprises a first portion 20 and a second portion 30 that is moveable with respect to the first portion 20. In some embodiments, the second portion 30 is arranged to pivot with respect to the first portion 20 about an axis 36. In some embodiments, the second portion 30 is attached to the first portion 20 by a pin 38. In some embodiments, the pin 38 comprises a hinged connection between the first portion 20 and the second portion 30.

In some embodiments, the first portion 20 is configured for attachment to a shooting device. In some embodiments, a shooting device supports the first portion 20 and the first portion 20 supports the second portion 30. In some embodiments, the grip 10 comprises a cavity 18 arranged to engage and contact a portion of a shooting device. In some embodiments, the cavity 18 is configured for attachment to a picatinny rail, for example comprising a hexagonal or modified-dovetail cross-sectional shape. In some embodiments, the cavity 18 is at least partially defined by a surface of a connector 19 that is attachable to the body of the first portion 20, for example by a fastener such as a screw.

In some embodiments, the second portion 30 is configured to be contacted by a hand. In some embodiments, the second portion 30 comprises a contacting surface 31 comprising a peak 32 and a valley 34. In some embodiments, the contacting surface 31 is configured such that the palm of a shooter's hand contacts the peak 32 and the thenar webspace of the shooter's hand contacts the valley 34.

Figure 3:
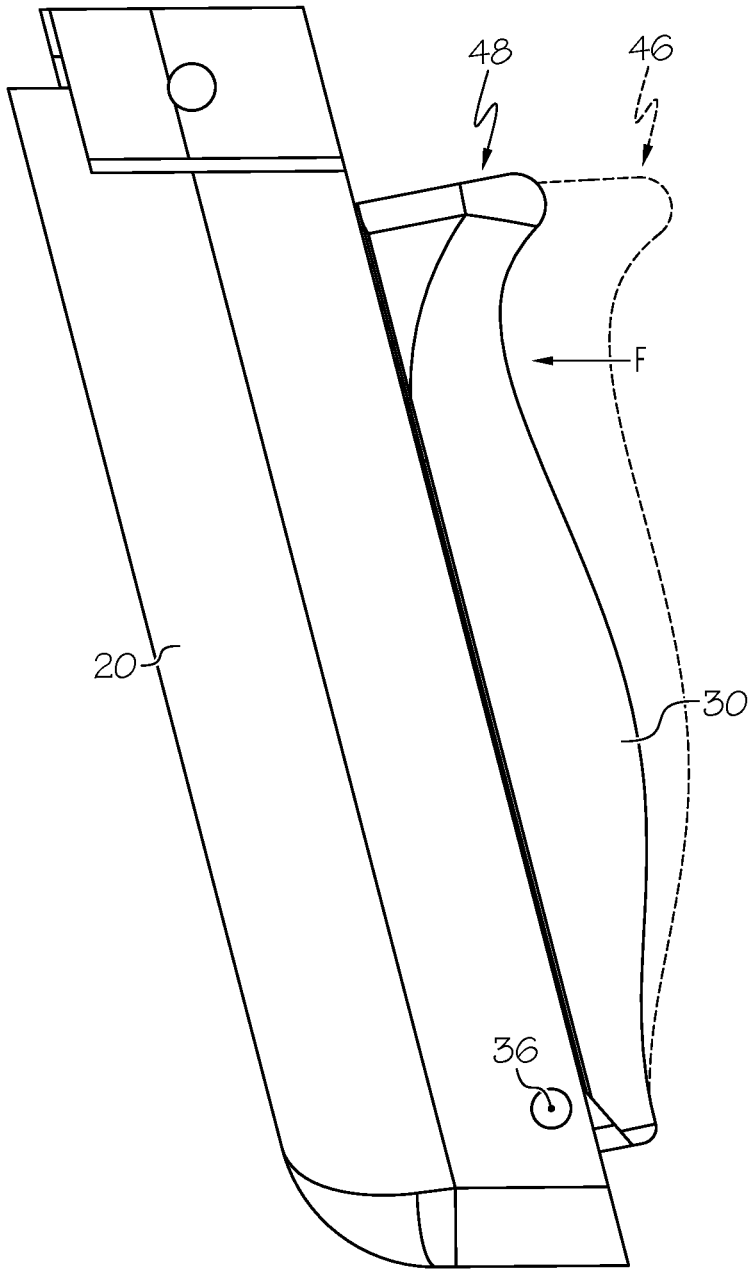
FIG. 3 shows movement of an embodiment of a grip.

FIG. 3 shows an embodiment of a grip 10 and illustrates movement between the first portion 20 and second portion 30. In some embodiments, the second portion 30 is moveable with respect to the first portion 20 between a first position 46 and a second position 48. In some embodiments, the movement comprises a translation of the second portion 30. In some embodiments, the movement comprises a rotation of the second portion 30. As illustrated in FIG. 3, the second portion 30 pivots about an axis 36.

In some embodiments, the second portion 30 is biased to the first position 46 and will assume the first position 46 when no external forces are applied. When a force F is applied to the second portion 30, the second portion 30 can travel towards the second position 48. In some embodiments, the second position 48 represents an end of the travel of the second portion 30.

Figure 4:
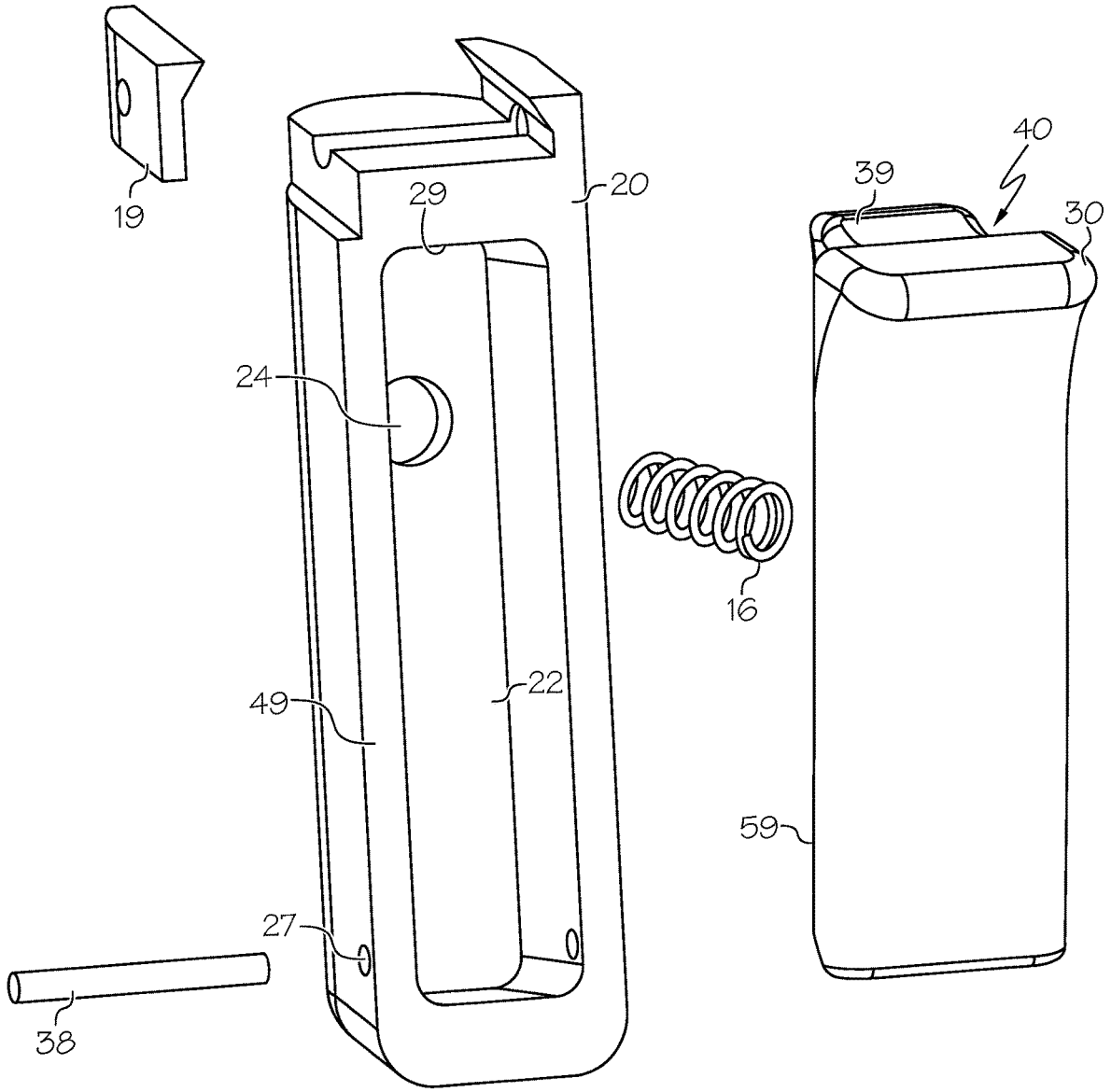
FIGS. 4 and 5 show exploded views of the grip of FIG. 1.
Figure 5:
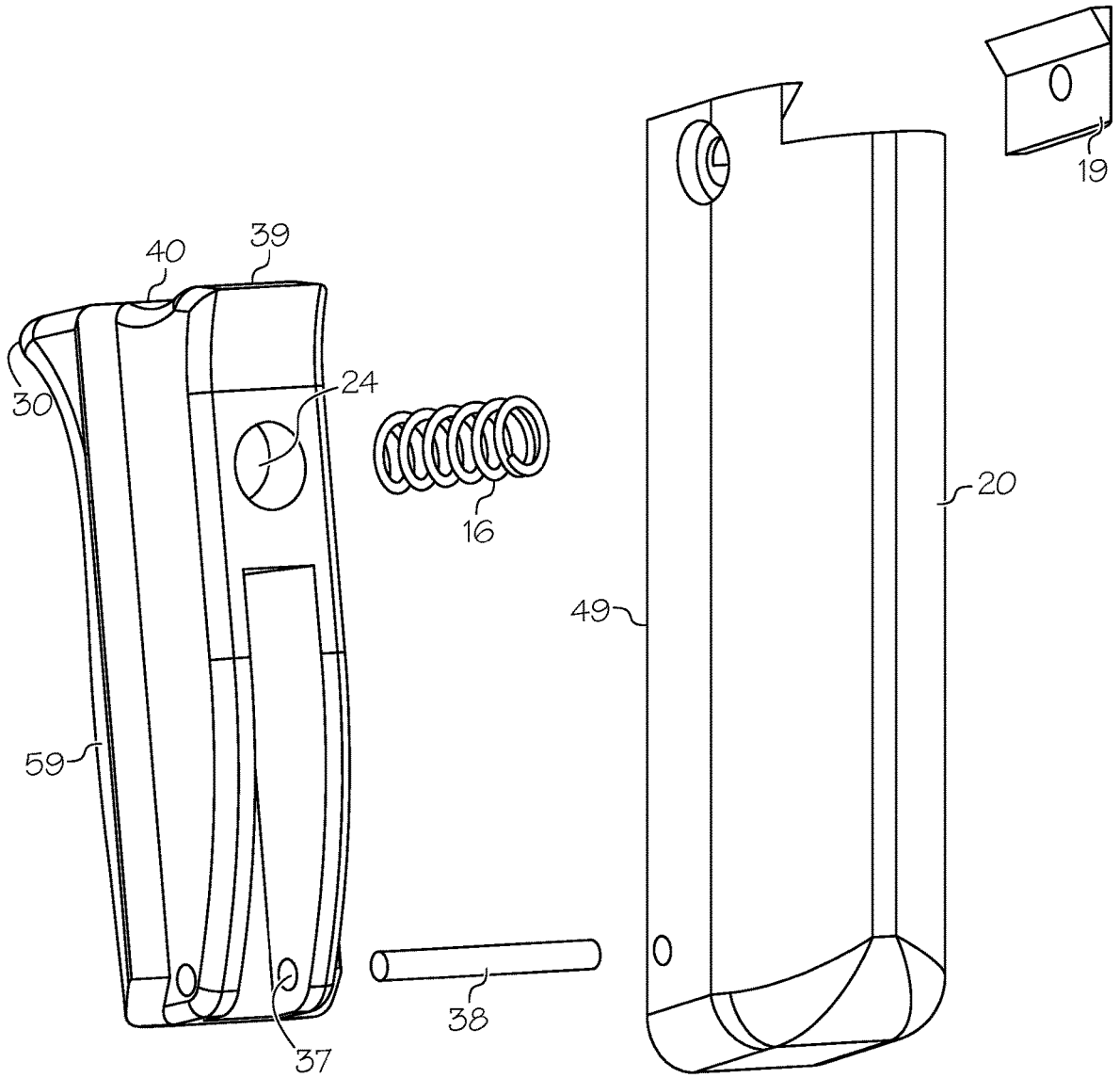

FIGS. 4 and 5 show exploded views of the grip 10 of FIG. 1. In some embodiments, the first portion 20 comprises a cavity 22. In some embodiments, at least a portion of the second portion 30 is oriented in the cavity 22.

In some embodiments, a biasing member 16 comprises a spring. In some embodiments, the biasing member 16 comprises a coil spring. In some embodiments, the biasing member 16 is compressed as the second portion 30 moves with respect to the first portion 20. In some embodiments, the strength of the biasing member 16 is selected to provide a desired amount of movement in the grip 10 in response to the levels of force applied to the grip 10 by a user.

In some embodiments, the first portion 20 comprises a seat 24 arranged to engage and anchor the biasing member 16. In some embodiments, the second portion 30 comprises a seat 24. A seat 24 can have any suitable configuration. In some embodiments, a seat 24 comprises a recess, blind hole or cavity. In some embodiments, a seat 24 comprises a post.

A biasing member 16 can have any suitable strength characteristics. In some embodiments, a biasing member 16 comprises a constant spring rate. In some embodiments, a biasing member 16 comprises a variable spring rate.

In some embodiments, a pin 38 comprises a connector that engages the first portion 20 and the second portion 30. In some embodiments, the pin 38 engages apertures 27 provided in the first portion 20. In some embodiments, the pin 38 engages apertures 37 provided in the second portion 30.

Figure 6:
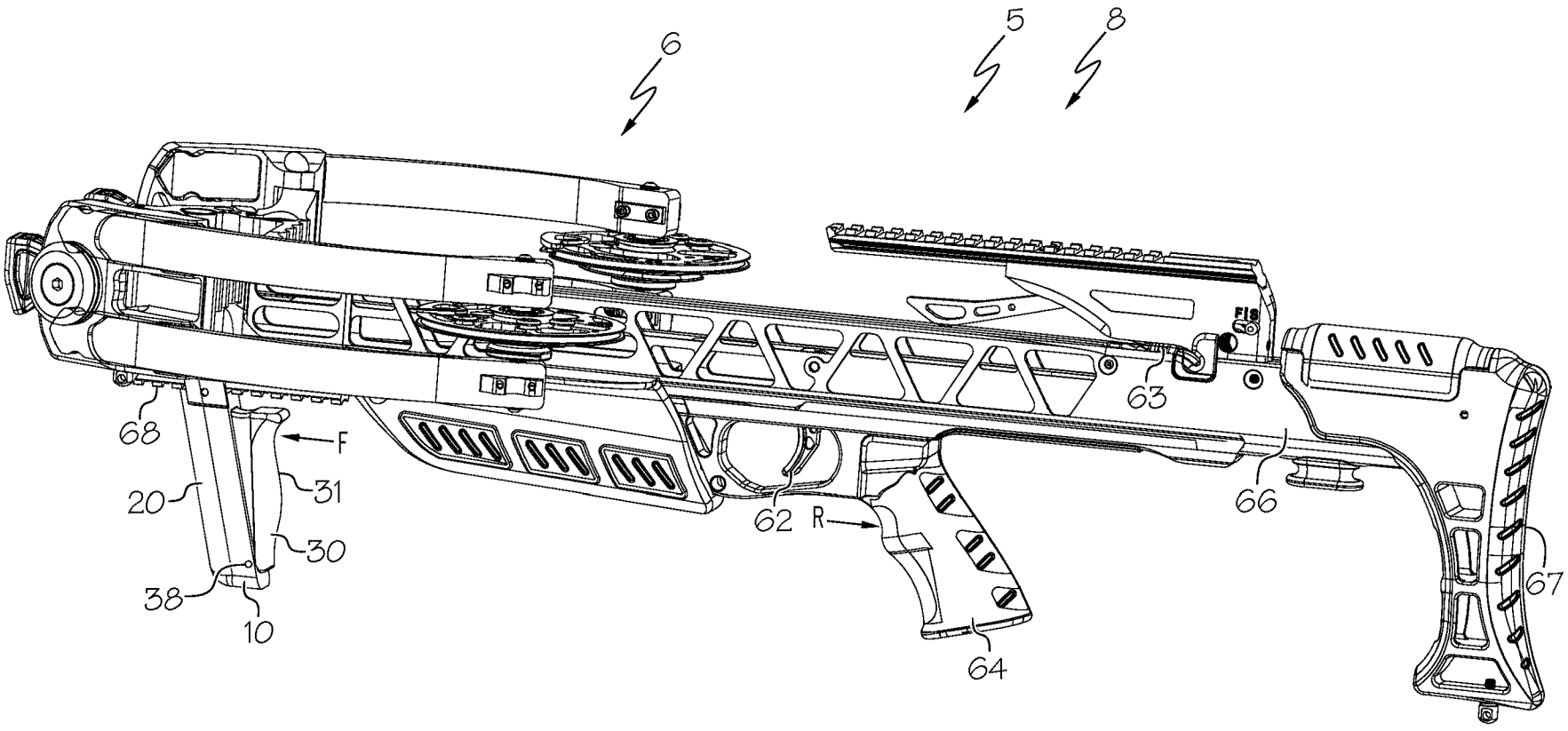
FIG. 6 shows an embodiment of a crossbow comprising a grip.

In some embodiments, at least one of the first or second portion 20, 30 comprises a stop 39, and the other portion 20, 30 comprises an interfering surface 29. In some embodiments, the stop 39 contacts the interfering surface 39 and limits relative movement between the portions 20, 30. As shown in FIGS. 5 and 6, the second portion 30 comprises a stop 39, and the stop 39 comprises a protrusion. In some embodiments, the stop 39 is arranged to contact the interfering surface 29 when the second portion 30 is in the first position 46.

In some embodiments, the grip 10 comprises a recess 40 located adjacent to the stop 39. In some embodiments, the recess 40 provides clearance for the interfering surface 29. In some embodiments, as the second portion 30 moves with respect to the first portion 30 and travels toward the second position 48, the interfering surface 29 becomes positioned in the valley 40. In some embodiments, the stop 39 is located opposite the pin 38. In some embodiments, the stop 39 and the pin apertures 37 are provided on opposite ends of the second portion 30.

In some embodiments, the grip 10 comprises a second stop 59 and a second interfering surface 49. In some embodiments, the second stop 59 and second interfering surface 49 are associated with a second end of travel of the second portion 30 with respect to the first portion 20. In some embodiments, the second stop 59 contacts the second interfering surface 49 and prevents further movement when the second portion 30 is in the second position 48.

FIG. 6 shows an embodiment of a shooting device 8 comprising a grip 10 as shown in FIG. 1. In some embodiments, a shooting device 8 comprises a crossbow 5 comprising a bow portion 6, trigger 62 and a latch 63. In some embodiments, a crossbow 5 comprises features as disclosed in U.S. Pat. No. 9,671,189, the entire content of which is hereby incorporated herein by reference.

In some embodiments, a shooting device 8 comprises a rear grip 64 located adjacent to the trigger 62. In some embodiments, a grip 10 is attached to the shooting device 8. In some embodiments, the shooting device 8 comprises a picatinny rail 68, and the grip 10 is attached to the picatinny rail 68. In some embodiments, the grip 10 comprises a foregrip that is attached to the shooting device 8 at a location forward of the trigger 62.

In some embodiments, the shooting device 8 comprises a stock 66 and a butt 67. In some embodiments, the butt 67 is arranged to contact the shoulder of a person using the shooting device 8.

In some embodiments, a force F applied to the contacting surface 31 of the grip 10 will cause the second portion 30 to move with respect to the first portion 20. In some embodiments, the first portion 20 is fixedly attached to the shooting device 8, and the force F causes the second portion 30 to move with respect to the shooting device 8. In some embodiments, the shooter can also apply a reacting force R to another portion of the shooting device 8. In some embodiments, a reacting force R is applied to the rear grip 64. When a shooter applies counteracting forces such as the force F and the reacting force R to the shooting device 8, accuracy may be improved. For example, an amount of "float" present during aiming can be reduced upon the application of counteracting forces.

In some embodiments, a shooting device 8 defines a shooting axis and a forward shooting vector. In some embodiments, a force F applied to the contacting surface 31 is arranged in the direction of the forward shooting vector (e.g. parallel to the forward shooting vector).

In some embodiments, the amount of movement of the grip 10 in response to an applied force F can be adjusted to better suit the user. In some embodiments, different biasing members 16 can be used that provide different movement characteristics. A biasing member 16 with a higher spring rate can move less in response to a predetermined force F than a biasing member with a lower spring. In some embodiments, multiple biasing members 16 are provided for use in the grip 10. In some embodiments, a grip 10 can comprise an adjustment mechanism to move an at-rest location of the biasing member 16. For example, in some embodiments, an adjustment mechanism comprises a seat 24 for the basing member 16. In some embodiments, the adjustment mechanism allow the specific location of the seat 24 to be adjusted with respect to the body portion 20, 30 that supports the sear 25. In some embodiments, a threaded adjustment mechanism can be used to move the seat 24. This can be used to continuously adjust the spring force of the grip 10 without changing the biasing member 16.

Figure 7:
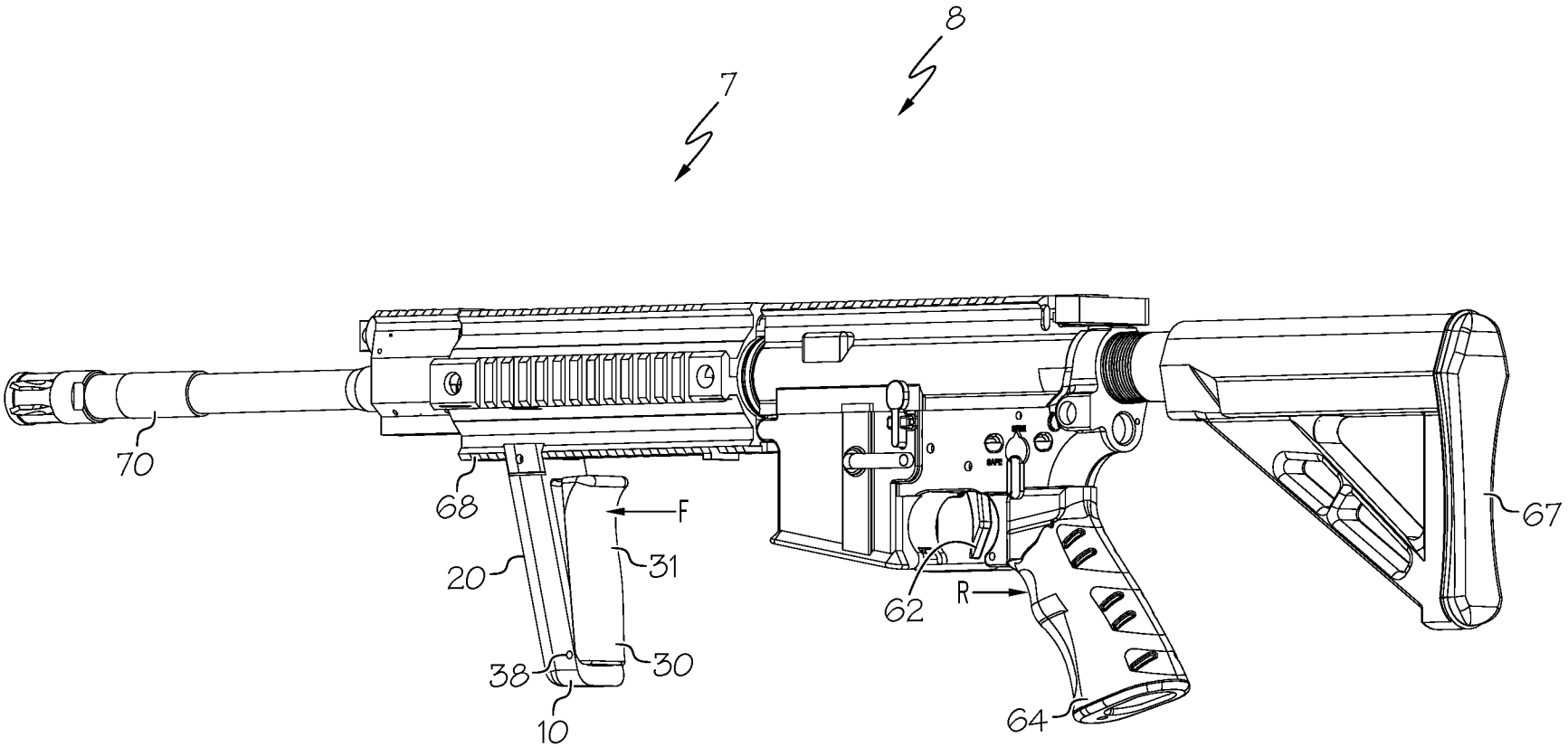
FIG. 7 shows an embodiment of a sporting rifle comprising a grip.

FIG. 7 shows another embodiment of a shooting device 8 comprising a grip 10. In some embodiments, a shooting device 8 comprises a gun 7 arranged to fire bullets. In some embodiments, a gun 7 comprises a trigger 62 and a barrel 70. In some embodiments, a gun 7 comprises a picatinny rail 68. The stabilizing arrangement created by an applied force F and a reacting force R described with respect to a crossbow 5 can similarly be used in a gun 7.

Figure 8:
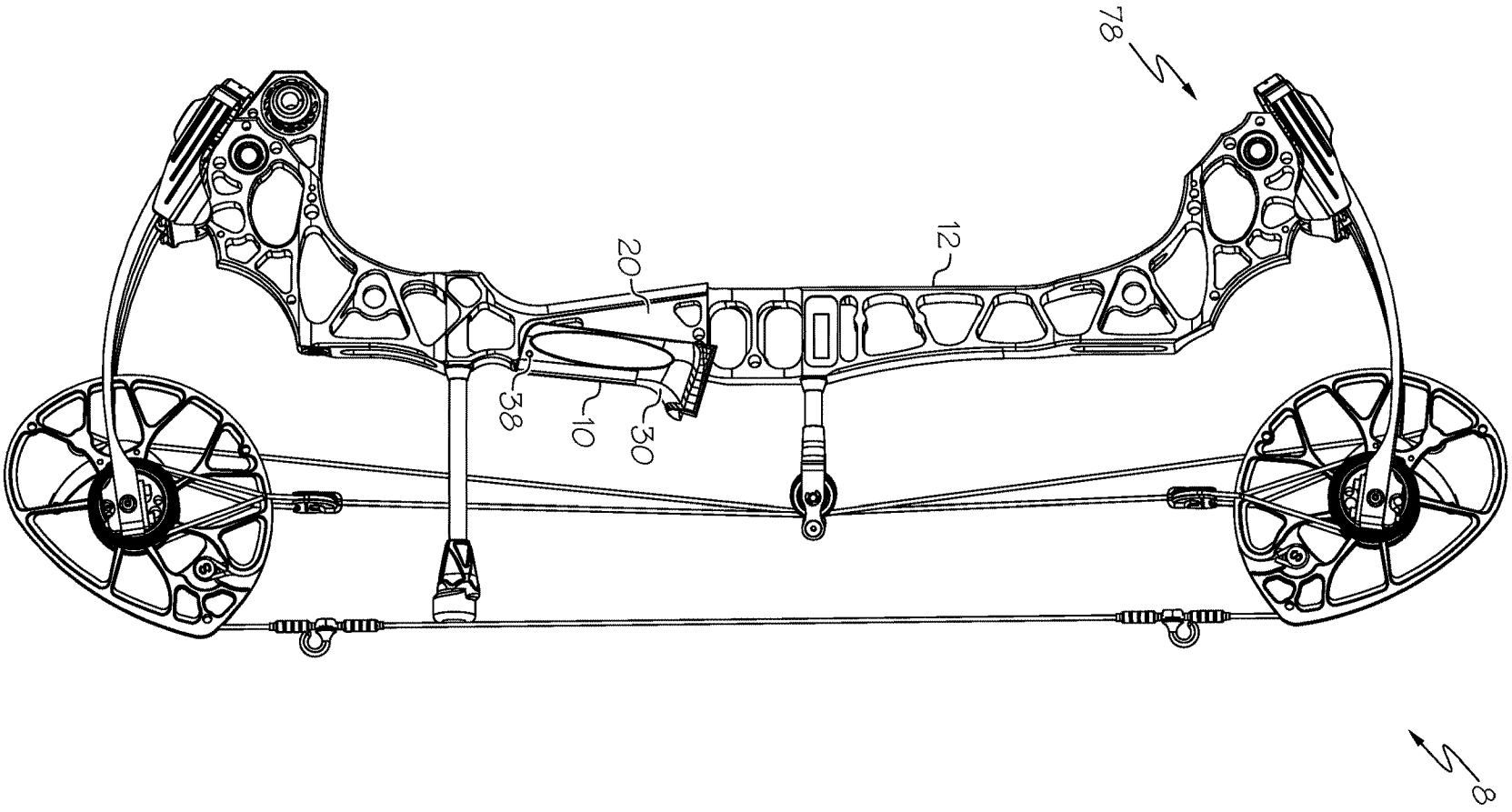
FIG. 8 shows an embodiment of an archery bow comprising a grip.
Figure 9:
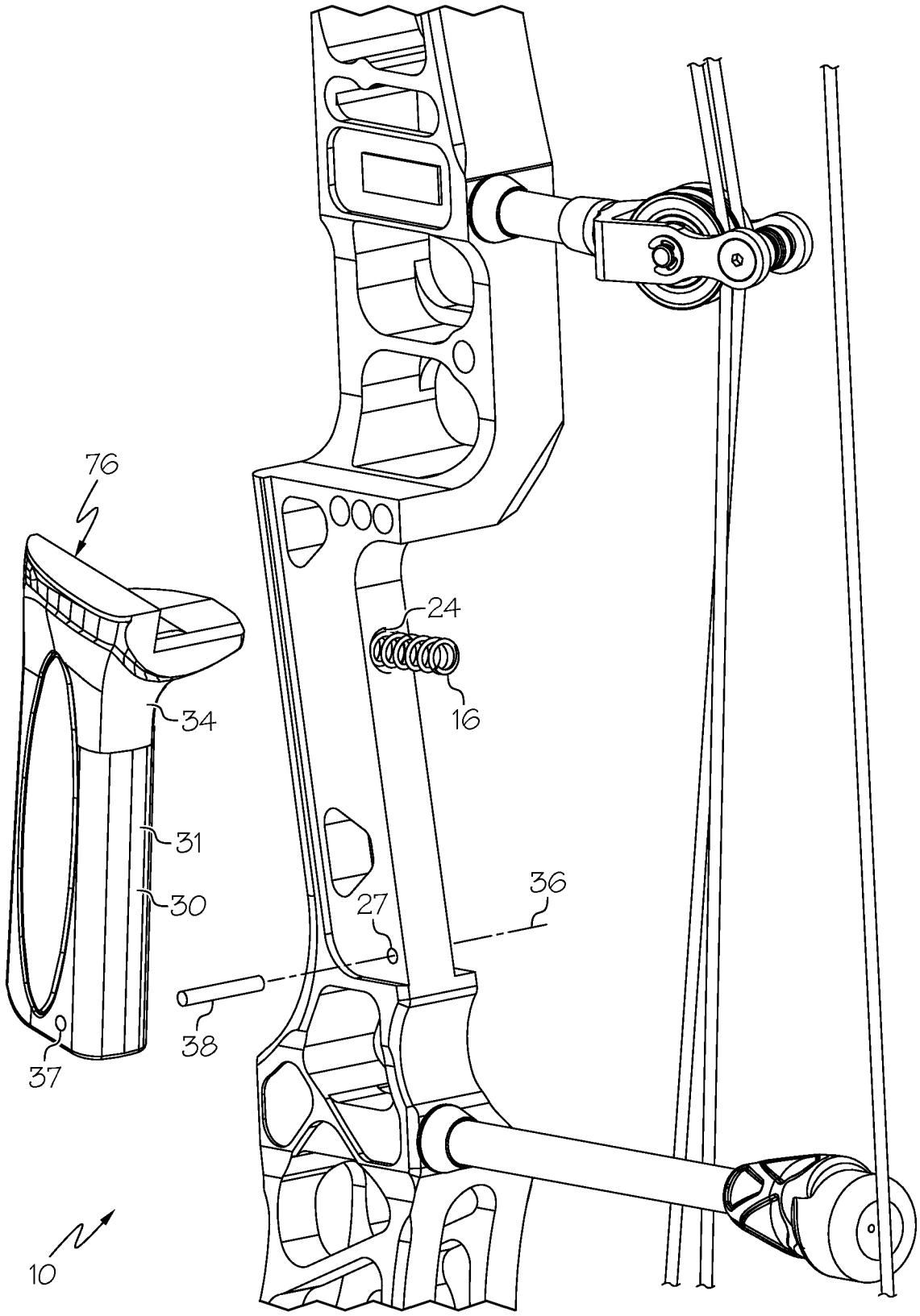
FIG. 9 shows an exploded view of the archery bow of FIG. 8.

FIGS. 8 and 9 show another embodiment of a shooting device 8. In some embodiments, a shooting device 8 comprises an archery bow 78 comprising a riser 12 and a grip 10. In some embodiments, an archery bow 78 comprises features as described in US 2016/0341511, the entire disclosure of which is hereby incorporated herein by reference.

In some embodiments, the grip 10 comprises a first portion 20 arranged to move with respect to a second portion 30, and the first portion 20 comprises an integral portion of the shooting device 8. In some embodiments, the first portion 20 comprises a portion of the riser 12. In some embodiments, the second portion 30 of the grip 10 comprises a cavity and a portion of the riser 12 is oriented in the cavity.

In some embodiments, the riser 12 comprises a seat 24 and the grip 10 comprises a biasing member 16.

Figure 10:
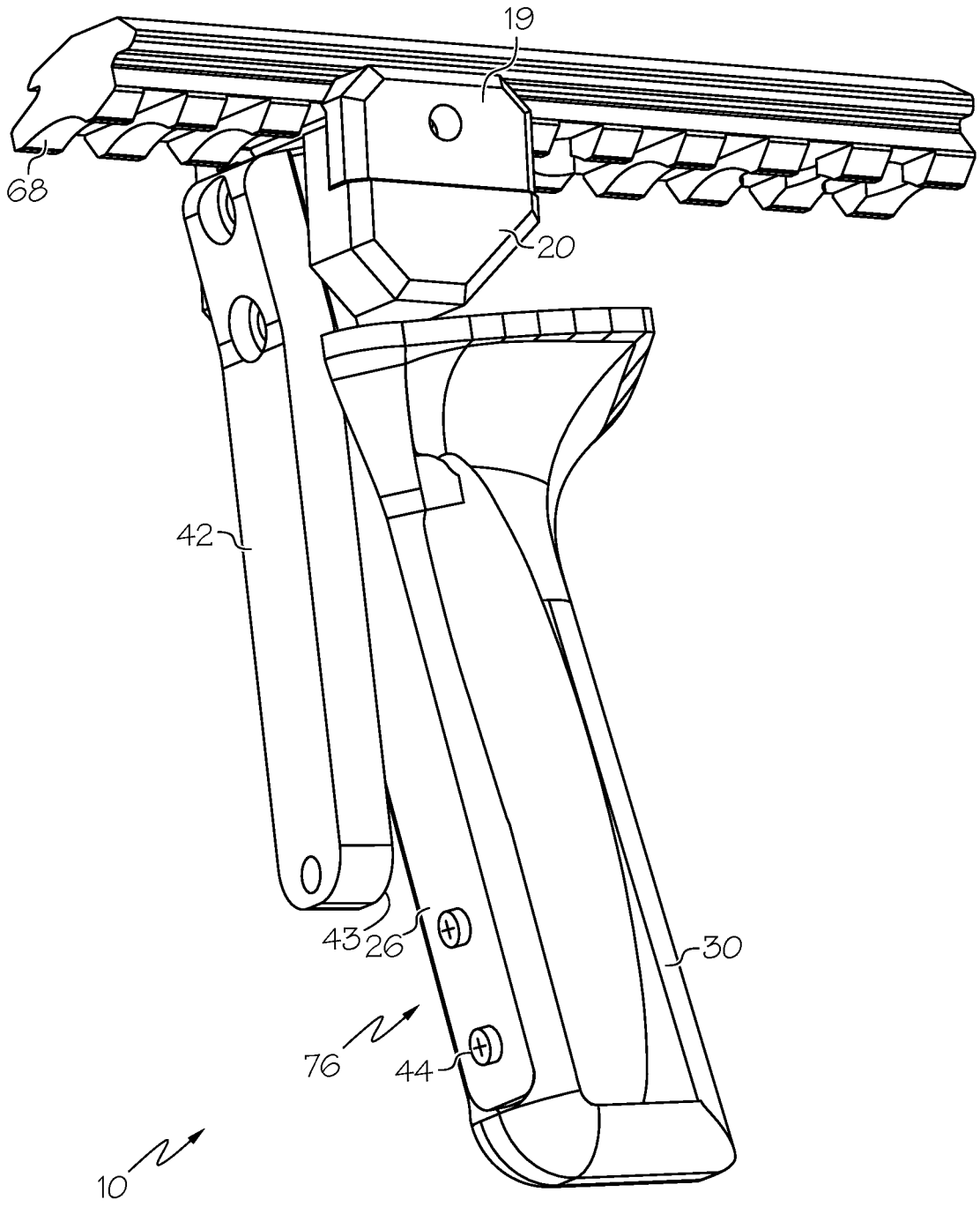
FIG. 10 shows another embodiment of a grip.
Figure 11:
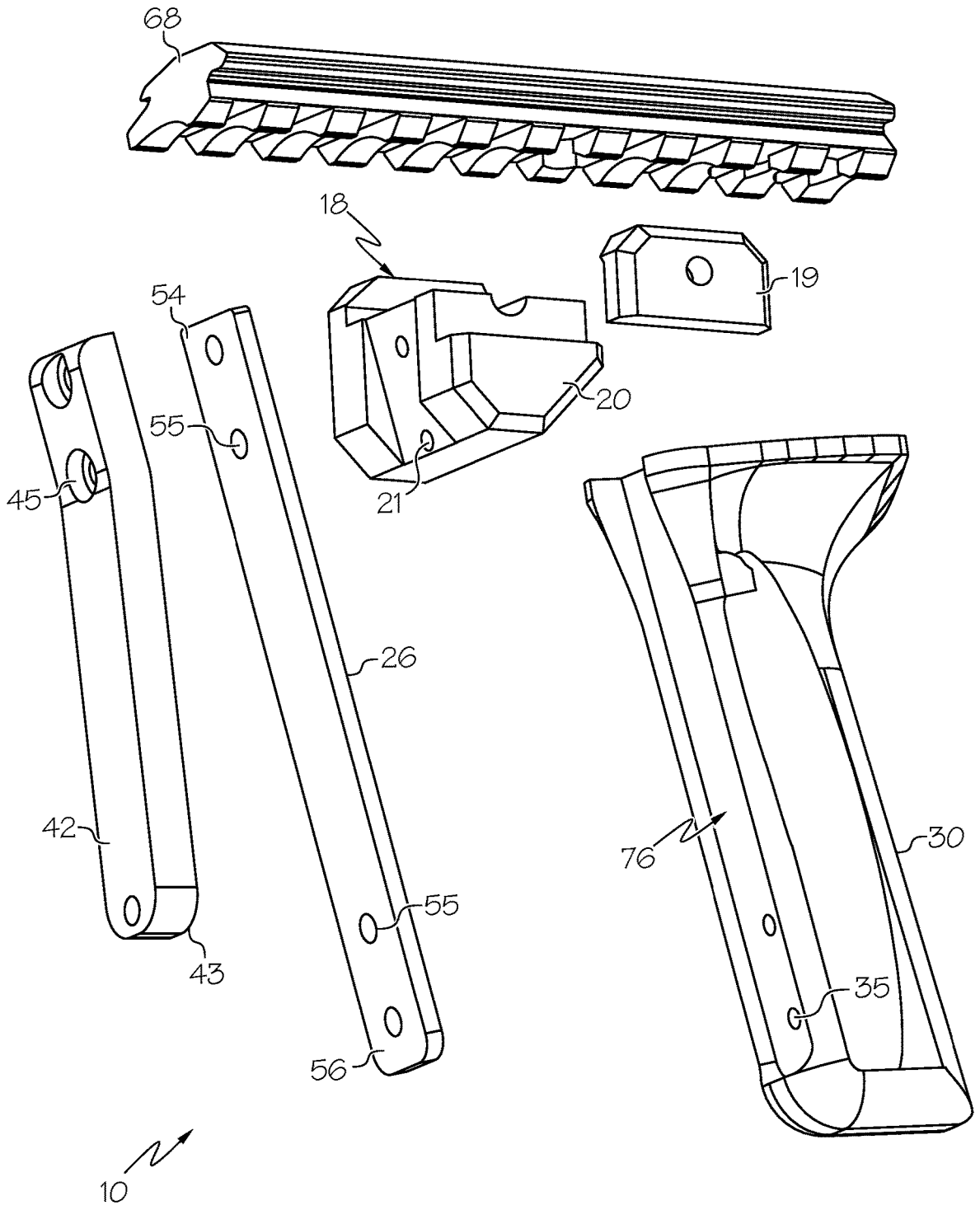
FIG. 11 shows an exploded view of the grip shown in FIG. 10.

FIGS. 10 and 11 show another embodiment of a grip 10. In some embodiments, a grip 10 comprises a first portion 20 and a second portion 30 that is moveable with respect to the first portion 20. In some embodiments, the grip 10 comprises a limb 26. In some embodiments, a limb 26 comprises a resilient member arranged to deform elastically. In some embodiments, the limb 26 is supported by the first portion 20. In some embodiments, the second portion 30 is supported by the limb 26. Desirably, the limb 26 comprises a material that is more flexible than a material used for the first portion 20. When a force is applied to the second portion 30, the limb 26 will flex to allow the relative movement between the first portion 20 and the second portion 30.

In some embodiments, the limb 26 functions as a flat spring. In some embodiments, the limb 26 deflects by bending along its length. A limb 26 can be made from any suitable material. In some embodiments, a limb 26 comprises a metal such as spring steel or other metals suitable for use in springs. In some embodiments, a limb 26 comprises a composite material comprising polymer and reinforcing fibers such as glass, carbon fiber, etc. A limb 26 can have any suitable size and strength, and will generally be sized to influence the desired deflection characteristics of the grip 10.

In some embodiments, the limb 26 is supported by the first portion 20 as a cantilever. In some embodiments, the first portion 20 comprises one or more apertures 21, each arranged to receive a fastener that attaches the limb 26 to the first portion 20. In some embodiments, a first end 54 of the limb 26 comprises apertures 55 aligned with the apertures 21 of the first portion.

In some embodiments, the second portion 30 comprises a cavity 76 and a portion of the limb 26 is oriented in the cavity. In some embodiments, the second portion 30 comprises one or more apertures 35, each arranged to receive a fastener 44. In some embodiments, the limb 26 comprises apertures 55 aligned with the apertures 35 of the second portion 30. In some embodiments, the apertures 55 are located at a second end 56 of the limb 26.

In some embodiments, the grip 10 comprises a stop member 42. In some embodiments, the stop member 42 comprises an interfering portion 43 arranged to limit the travel of the second portion 30 with respect to the first portion 20. In some embodiments, the stop member 42 is fixedly engaged with the first portion 20 and the interfering portion 43 is arranged to contact the limb 26, the second portion 30, or both, wherein the contact will limit movement of the second portion 30.

In some embodiments, the stop member 42 comprises one or more apertures 45 and can function as a washer to fasteners attaching the stop member 42 and limb 26 to the first portion. In some embodiments, the apertures 45 are aligned with apertures in the limb 26, and with apertures 21 in the first portion.

Figure 12:
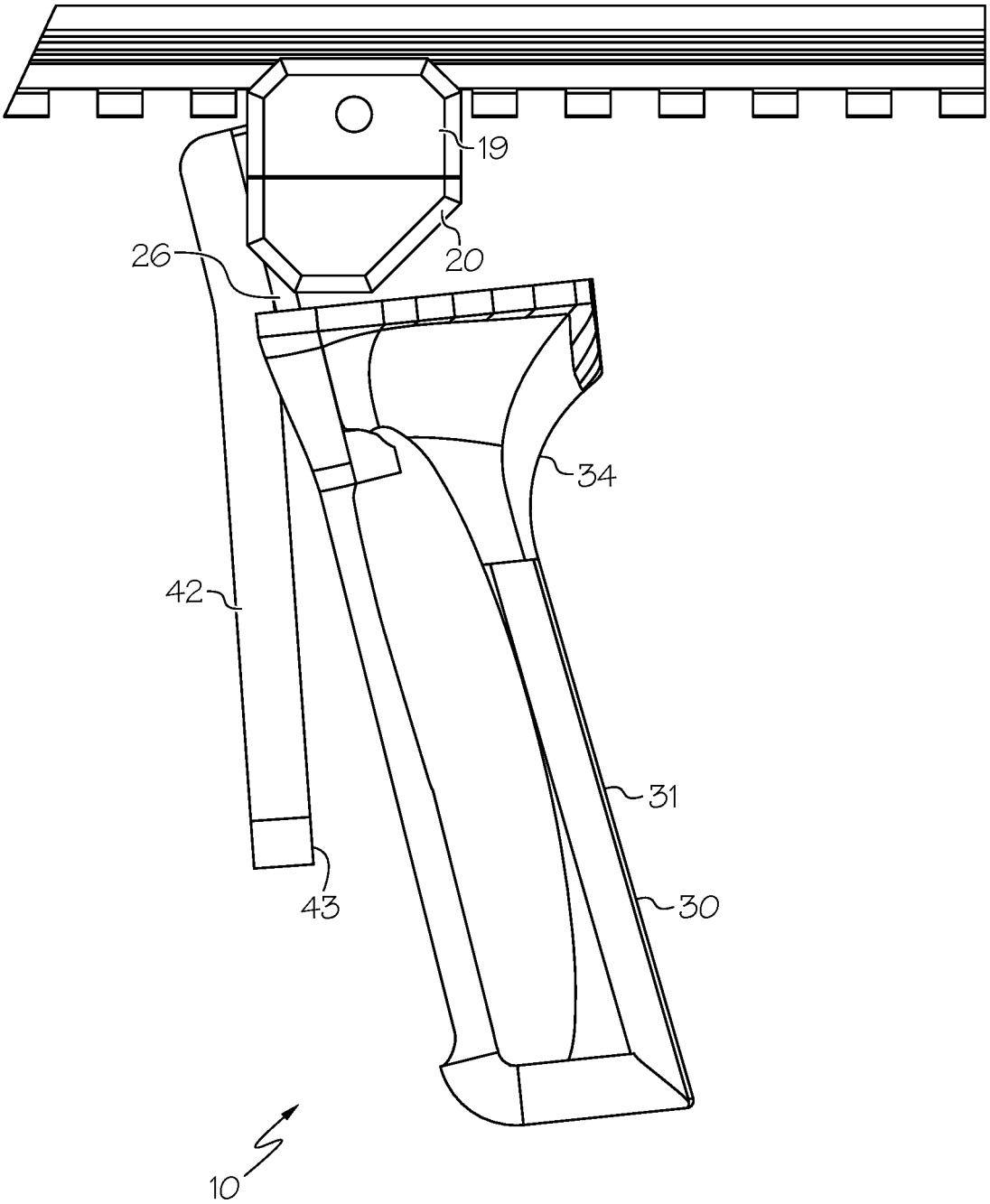
FIGS. 12 and 13 show side views of the grip of FIG. 10.
Figure 13:
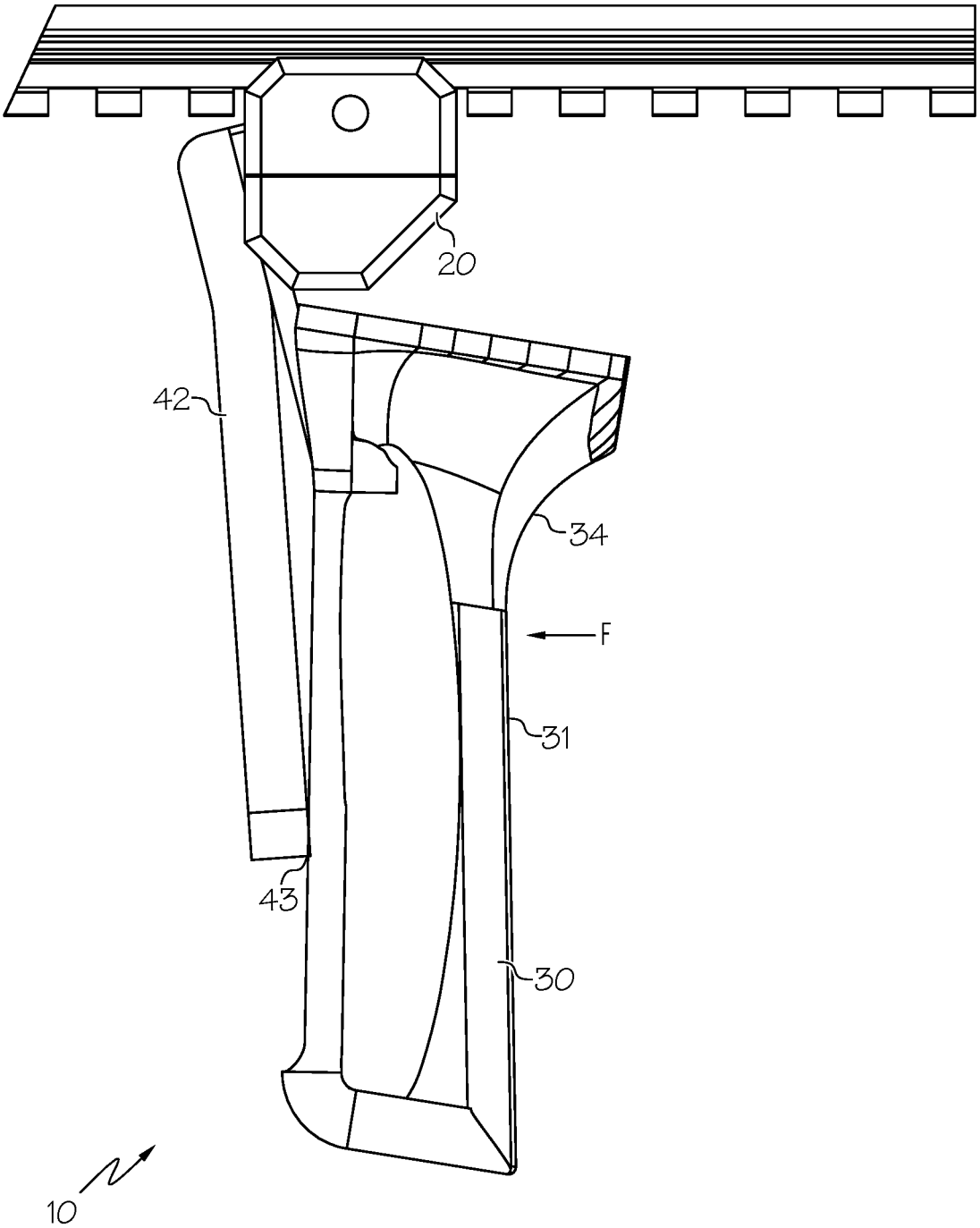

FIG. 12 shows a side view of the grip 10 of FIGS. 10 and 11. FIG. 13 shows the second portion 30 of the grip 10 moving with respect to the first portion 20 in response to an applied force F. The second portion 30 is shown at the end of its range of travel with the interfering portion 43 limiting movement of the second portion.

Figure 14:
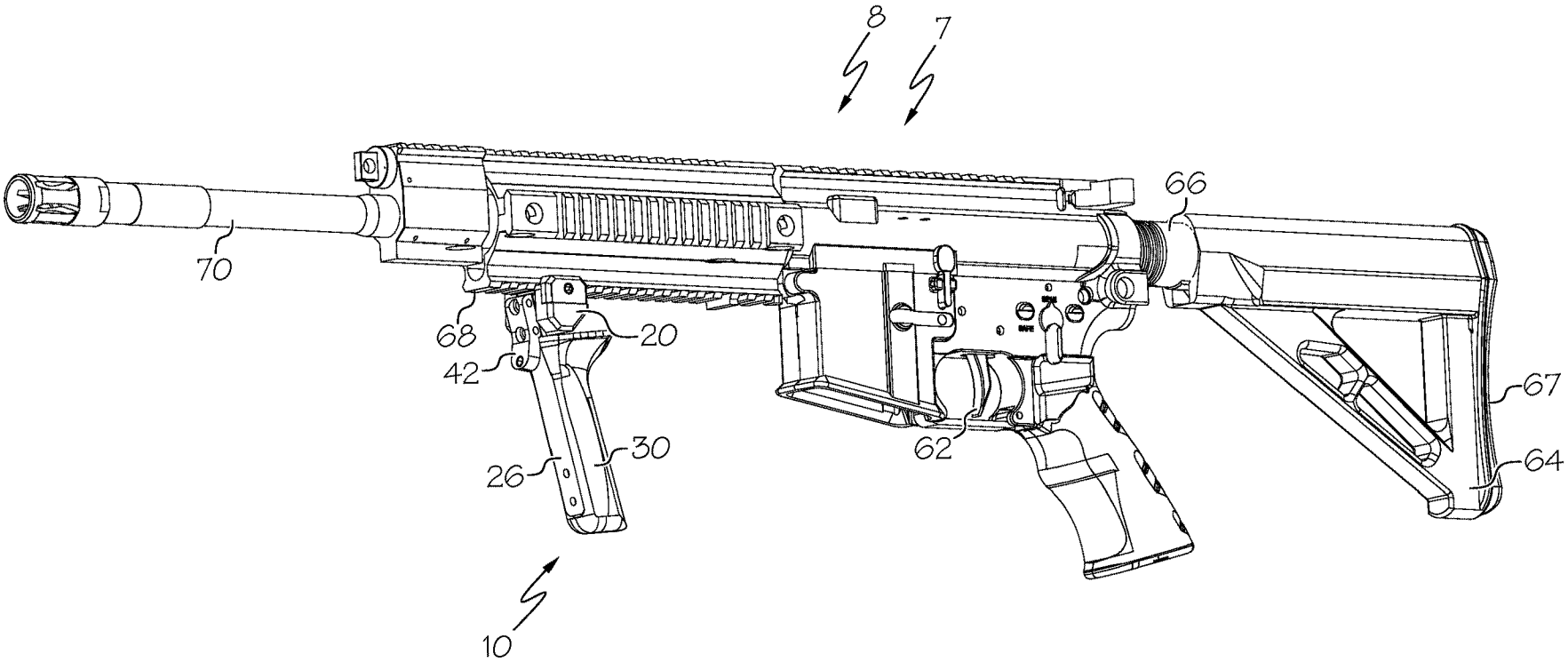
FIG. 14 shows an embodiment of a grip on a gun.

FIG. 14 shows an embodiment of a grip 10 comprising a limb 26 attached to a gun 7.

Figure 15:
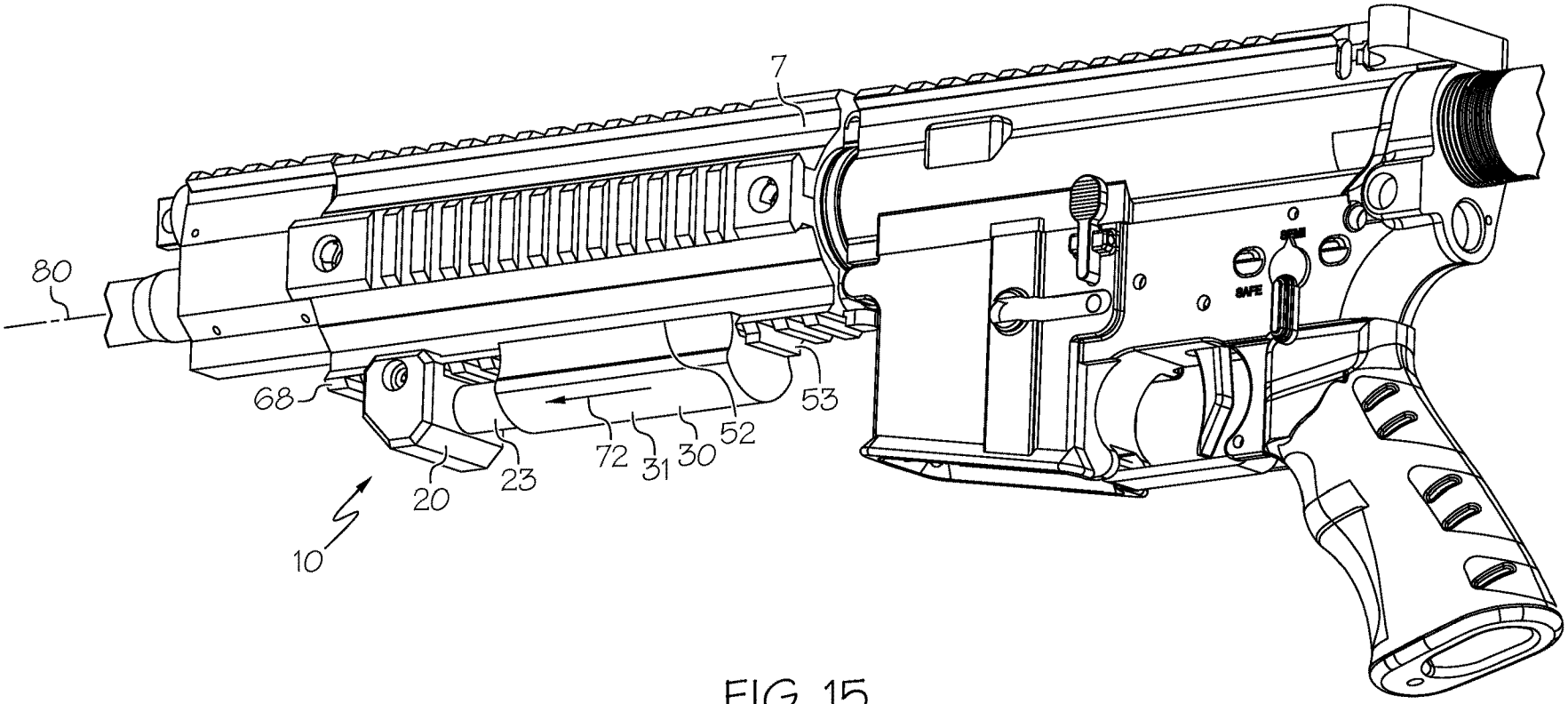
FIG. 15 shows another embodiment of a grip.
Figure 16:
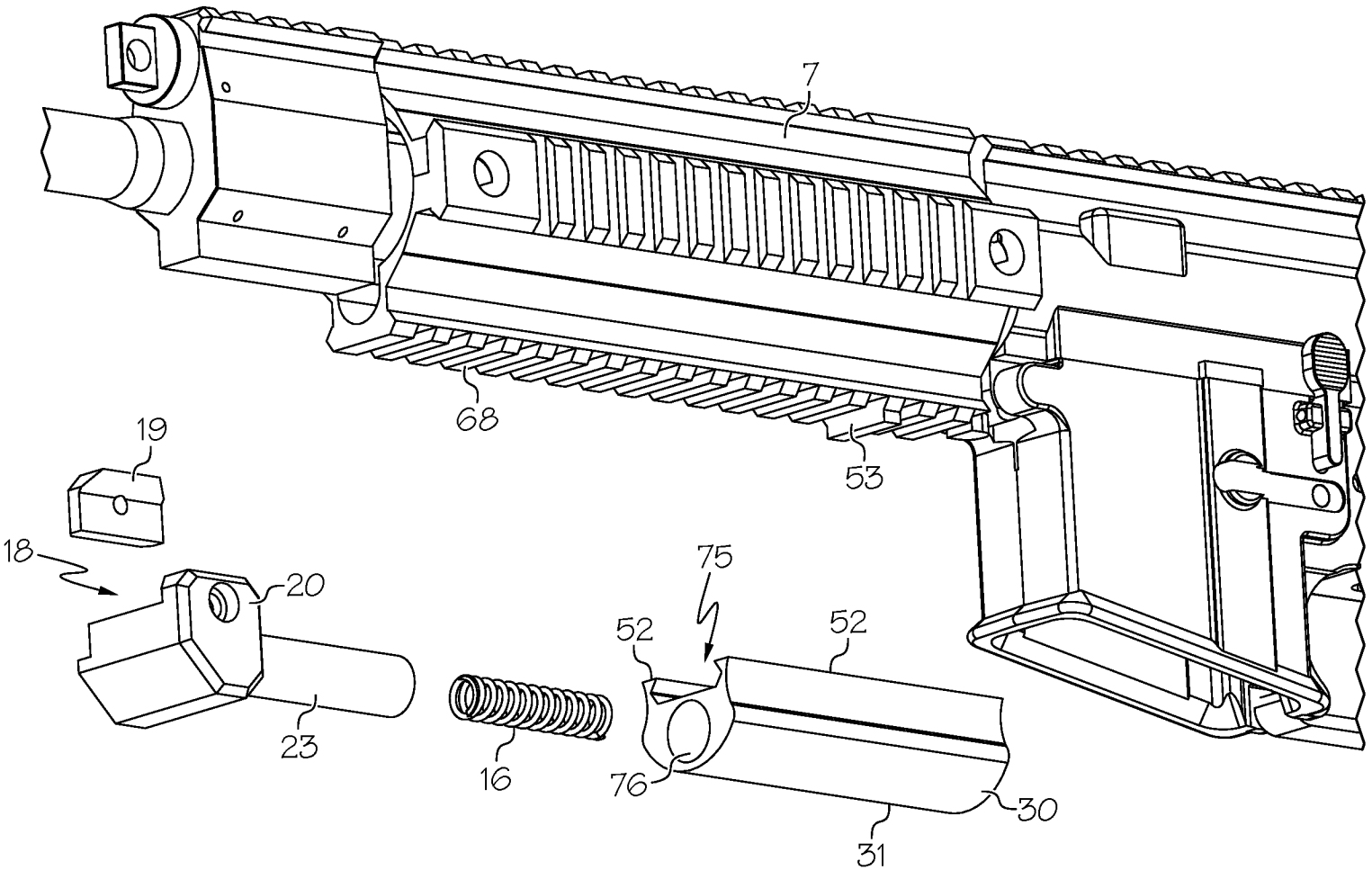
FIG. 16 shows an exploded view of the grip of FIG. 15.

FIG. 15 shows another embodiment of a grip 10 attached to a gun 7. FIG. 16 shows an exploded view of the grip 10 of FIG. 15. In some embodiments, a grip 10 comprises a first portion 20 and a second portion 30 moveable with respect to the first portion 20. In some embodiments, the second portion 30 is arranged to move along a linear path 72 with respect to the first portion 20 as a force is applied to the second portion 30. In some embodiments, the linear path 72 is parallel to a shooting axis 80 of the gun 7.

In some embodiments, the first portion 20 is configured for attachment to a portion of a gun 7 such as a picatinny rail 68. In some embodiments, the grip 10 comprises a cavity 18 arranged to engage the picatinny rail 68. In some embodiments, the cavity 18 is at least partially defined by a surface of a connector 19 that is attachable to the body of the first portion 20, for example by a fastener such as a screw.

In some embodiments, the second portion 30 is configured to be contacted by a hand. In some embodiments, the second portion 30 comprises a contacting surface 31 arranged to contact the palm of a shooter's hand.

In some embodiments, the second portion 30 comprises a cavity 76. In some embodiments, a biasing member 16 is positioned in the cavity 76. In some embodiments, a portion of the first portion 20 extends into the cavity 76. In some embodiments, the first portion 20 comprises a protrusion 23 that extends into the cavity 76. In some embodiments, a central axis of the protrusion 23 is aligned with a central axis of the cavity 76, which can also be parallel to the shooting axis 80. In some embodiments, the biasing member 16 comprises a coil spring. In some embodiments, the biasing member 16 comprises a compression spring.

In some embodiments, the second portion 30 comprises guides 52 that define a guide cavity 75. In some embodiments, the guide cavity 75 comprises a longitudinal axis oriented parallel to the shooting axis 80. In some embodiments, the guides 52 are arranged to surround a portion of the gun 7, picatinny rail 68 or structure that supports the grip 10. In some embodiments, the guides 52 prevent the second portion 30 from rotating with respect to the first portion 20. In some embodiments, the guides 52 comprise a first guide and a second guide. In some embodiments, each guide comprises a guide surface comprising a shape arranged to engage a supporting surface. In some embodiments, a guide surface comprises a peak or valley, and a portion of the firearm 7 or picatinny rail comprises a complimentary shape. In some embodiments, the guides 52 each comprise a guide surface comprising a valley, and a supporting picatinny rail comprises complimentary peaks arranged to compliment the guide surface valley.

In some embodiments, a stop 53 is provided and arranged to limit movement of the second portion 30. In some embodiments, the stop 53 defines the maximum distance that the second portion 30 can move away from the first portion 20. In some embodiments, the biasing member 16 is under load when the second portion 30 abuts the stop 53. In some embodiments, a picatinny rail 68 comprises a stop 53. In some embodiments, a stop 53 comprises a separate structure that is attachable to the gun 7 or picatinny rail 68.

Figure 17:
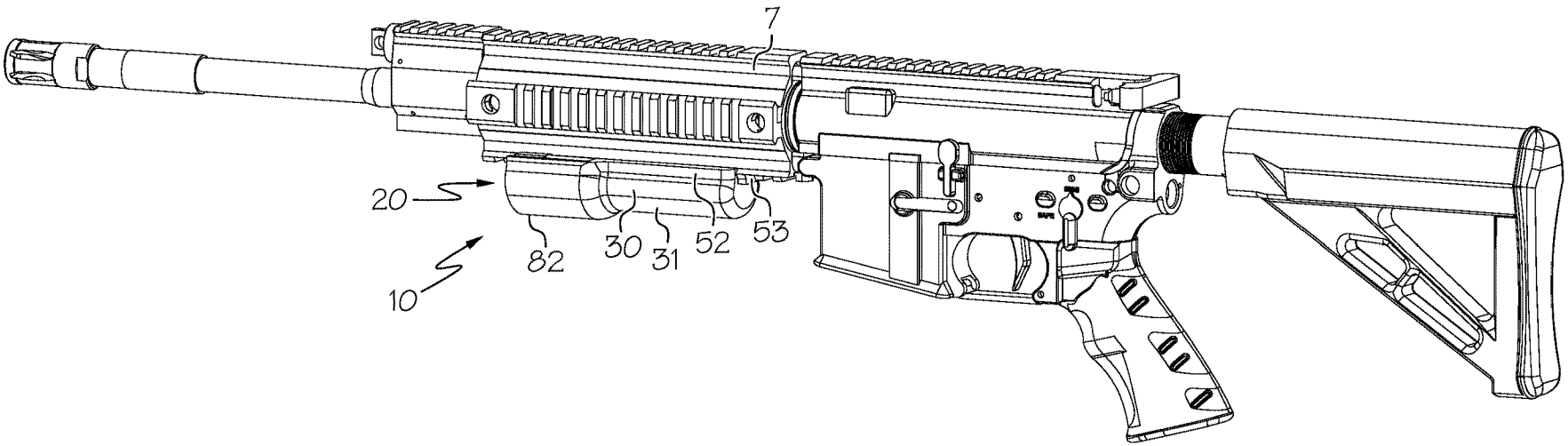
FIG. 17 shows another embodiment of a grip.
Figure 18:
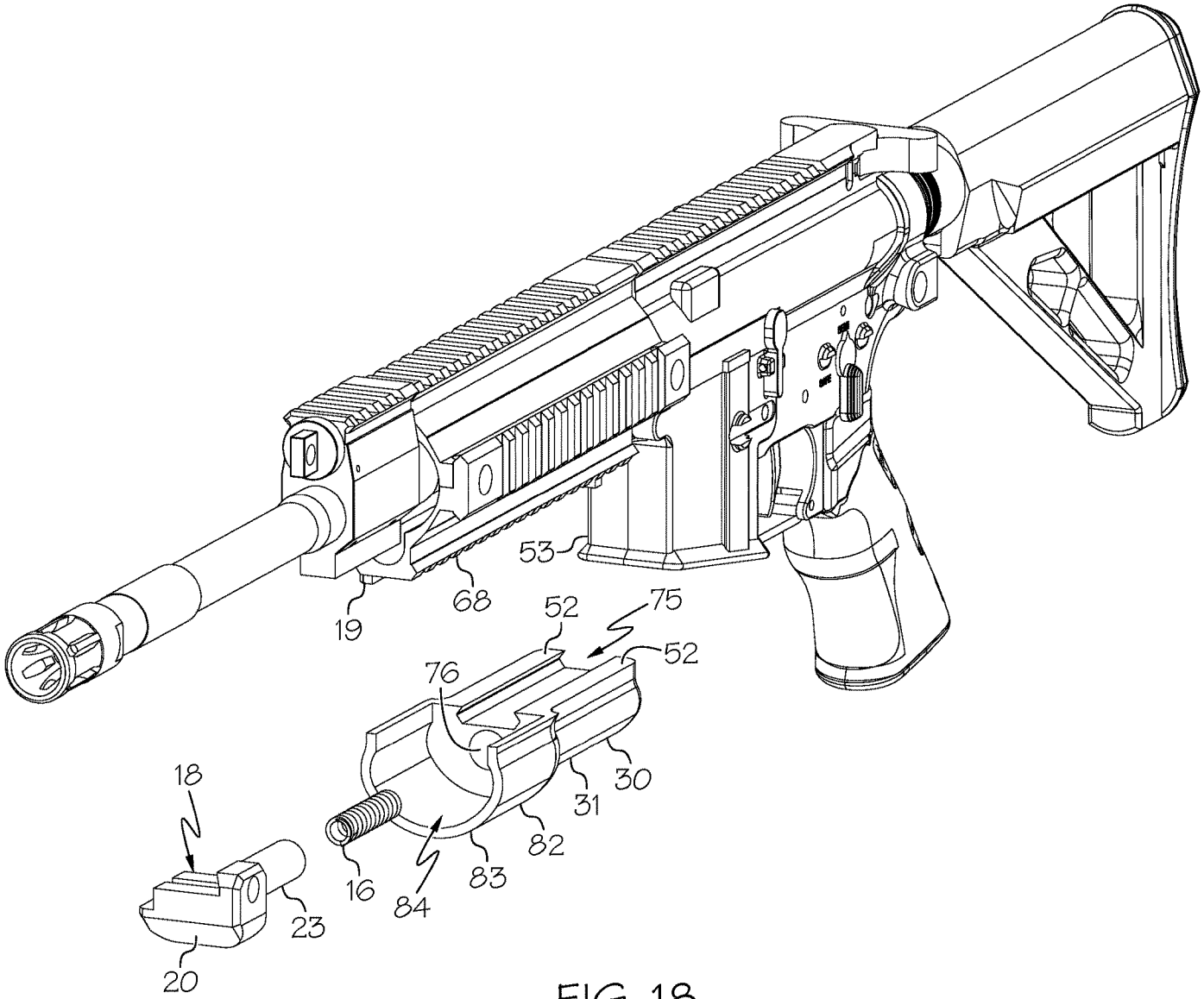
FIG. 18 shows an exploded view of the grip of FIG. 17.

FIG. 17 shows another embodiment of a grip 10 attached to a gun 7. FIG. 18 shows an exploded view of the grip 10 of FIG. 17. The embodiment of a grip 10 shown in FIG. 17 comprises many parts that are similar to the embodiment shown in FIG. 15. In some embodiments, the grip 10 further comprises a guard 82 arranged to cover portions of the device that move with respect to one another. In some embodiments, the second portion 30 comprises a guard 82. In some embodiments, the guard 82 is formed integrally with a body that also comprises a contacting surface 31 and guides 52.

In some embodiments, a guard 82 comprises a wall portion 83 that defines a guard cavity 84. When the second portion 30 of the grip 10 comprises the wall portion 83 defining the guard cavity 84, at least a portion of the first portion 20 is oriented in the cavity 84. In some embodiments, the guard 82 is arranged to prevent a shooter's hand from contacting the first portion 20 when the shooter's hand contacts the contacting surface 31.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A grip for a shooting device comprising:

a first body portion configured for attachment to the shooting device, the first body portion comprising a first cavity arranged to engage a firearm, a portion of the first cavity defined by a connector;

a resilient member attached to the first body portion, the first body portion supporting the resilient member; and a second body portion attached to the resilient member, the resilient member supporting the second body portion, the second body portion comprising a second cavity, a portion of the resilient member oriented in the second cavity, the second body portion moveable with respect to the first body portion between first and second positions, the resilient member deforming resiliently as the second body portion moves from the first position to the second position.

2. The grip of claim 1, the second body portion comprising a contacting surface arranged to contact a user's palm.

3. The grip of claim 2, the contacting surface comprising a valley.

4. The grip of claim 1, the resilient member comprising a flat spring.

5. The grip of claim 1, comprising a stop arranged to limit travel of the second body portion at the second position.

6. The grip of claim 5, the resilient member contacting the stop.

7. The grip of claim 6, the resilient member further comprising a portion that does not contact the stop in the first position.

8. The grip of claim 7, the portion contacting the stop in the second position.

9. A grip for a shooting device comprising:

a first body portion attached to a shooting device comprising a forward shooting vector;

a resilient member attached to the first body portion, the first body portion supporting the resilient member; and a second body portion attached to the resilient member, the resilient member supporting the second body portion, the second body portion moveable with respect to the first body portion between first and second positions, the resilient member deforming resiliently as the second body portion moves from the first position to the second position;

wherein applying a force in the direction of the forward shooting vector to the second body portion will move the second body portion with respect to the first body portion.

10. The grip of claim 1, the resilient member comprising a composite material comprising reinforcing fibers.

11. A grip for a shooting device comprising:

a first body portion configured for attachment to the shooting device;

a resilient member attached to the first body portion, the first body portion supporting the resilient member; and a second body portion attached to the resilient member, the resilient member supporting the second body portion, the second body portion moveable with respect to the first body portion between first and second positions, the resilient member deforming resiliently as the second body portion moves from the first position to the second position;

first body portion arranged to engage a picatinny rail.

12. The grip of claim 1, wherein when the second body portion is in the first position, the resilient member is straight along its length.

13. The grip of claim 1, wherein the first body portion does not contact the second body portion.

14. The grip of claim 1, the resilient member biasing the second body portion to the first position.

* * * * *